US005982112A

United States Patent [19]

Pringle et al.

[11] Patent Number: 5,982,112

[45] Date of Patent: Nov. 9, 1999

[54] LOW PRESSURE XENON LAMP AND DRIVER CIRCUITRY FOR USE IN THEATRICAL PRODUCTIONS AND THE LIKE

[75] Inventors: David A. Pringle, Pacific Palisades; David McDonald, Canyon Country, both of Calif.; Zhong Fang Yan, Shangai, China; George Johnson, Hollywood, Calif.

[73] Assignee: David A. Pringle, Pacific Palisades, Calif.

[21] Appl. No.: 08/157,119

[22] PCT Filed: Jun. 4, 1992

[86] PCT No.: PCT/US92/04656

§ 371 Date: Mar. 22, 1994

§ 102(e) Date: Mar. 22, 1994

[87] PCT Pub. No.: WO92/22187

PCT Pub. Date: Dec. 10, 1992

[51] Int. Cl.[6] ..... H05B 37/02

[52] U.S. Cl. ..... 315/289; 315/290; 315/200 A; 315/DIG. 4; 315/194

[58] Field of Search ..... 315/289, 290, 315/200 A, 194, DIG. 4, 133

[56] References Cited

U.S. PATENT DOCUMENTS

| | | | |
|---|---|---|---|
| 3,488,558 | 1/1970 | Grafton | 315/360 |
| 3,497,768 | 2/1970 | Mathisen | 315/183 |
| 3,870,924 | 3/1975 | Helmuth | 315/200 A |
| 4,095,139 | 6/1978 | Symonds et al. | 315/293 |
| 4,095,140 | 6/1978 | Kirkhuff et al. | 305/199 |
| 4,301,392 | 11/1981 | Hirata | 315/133 |
| 4,477,796 | 10/1984 | Kearsley | 315/241 S |
| 4,687,985 | 8/1987 | Pitel | 323/323 |
| 4,697,122 | 9/1987 | Hoffer | 315/158 |
| 4,751,433 | 6/1988 | Baccanelli | 315/194 |

*Primary Examiner*—Michael B Shingleton
*Attorney, Agent, or Firm*—Ladas & Parry

[57] ABSTRACT

Disclosed is a low pressure xenon lamp (12) and the driver circuitry therefor for producing relatively short bursts of intense light from the lamp (12). The lamp (12), including its associated driver circuitry (50) can be used in theatrical, stage, movie and/or video production to simulate, among other things, bursts of lighting. The lamp (12) is installed in a fixture together with a power supply (20) and a control system (50) is provided for controlling when the lamp (12) is turned on and off. Preferably, the control system (50) includes manually operated switches (53, 57, 54) and preferably one or more controllers (50) can be coupled together in a series fashion, should it be desired to control the lamp (12) for a greater number of time cycles then permitted by a single controller (50). Alternative power supplies (20) are disclosed. One power supply (20) permits the intensity of the flashes of light (12) to be controlled.

23 Claims, 6 Drawing Sheets

A1
P1-3
Q1
P1-4
A2
P1-1
Q2
P1-2
100 OHM
1/2 WATT
R4
R5
R12
10 KOHM
R13
C7
C8
0.003 MFD
1 KVDC
U2
U3
4N40
DS2
RED
R3
100 OHM
1/2 WATT
K1-A
110
111
AUX.
RELAY
CONTACTS
COM.
N.C.
N.O.
K1-B
C2
100 MFD
15 VDC
101
U1A
R10
10 KOHM
R17
47 KOHM
C3
0.1 MFD
50 VDC
R18
50 KOHM
CR6
1N4004
103
MC3403
U1D
R16
390 KOHM
CR2
1N4741
11 VDC
98
CR5
1N4004
104
100
102
U1B
U1C
R11
10 KOHM
R15
180 KOHM
R7
10 KOHM
R8
10 KOHM
CR3
1N4004
R6
1 KOHM
CR4
1N4004
DS1
GREEN
R14
18 KOHM
C4
0.01 MFD
50 VDC
R9
10 KOHM
R2
47 KOHM
1/2 WATT
K
9Z
MDA920A7
CR1
P1-6
P1-5
C5
0.1 MFD
C6
0.1 MFD
12VAC
12VAC
S1
PUSH FOR
"LIGHTNING"
96
S+
S-
E+
E-
95
REMOTE
LEVEL SET
(0V-FULL OFF)
(3.5V-FULL ON)
TR1
240:12
26
12 VAC
12 VAC
14
10
22
23
Q1
29
C1
28
Q2
24
R1
A2
Q2
A1
Q1

LOW PRESSURE XENON LAMP AND DRIVER CIRCUITRY FOR USE IN THEATRICAL PRODUCTIONS AND THE LIKE

TECHNICAL FIELD

The present invention provides a lamp and associated driver circuitry which is programmable for the purpose of producing precisely controlled, short bursts of light for use in theatrical productions, on stage, in video productions and the like. The light produced can be intense and bright like a flash of nearby lightning or the flash can be of lower intensity like a flash of lightening off in the distance. The bursts of light are of a relatively short duration, and multiple bursts can be generated. Therefore, the lamp and associated driver circuits can be effectively used to simulate a bolt of lightning or a number of bolts of lightning, of varying intensity.

BACKGROUND

In theatrical, stage, and video productions, relatively short bursts of white light are sometimes used to mimic bolts of lightning, artillery fire and the like. In the prior art, bright flashes of light was produced by a manually operated scissors switch wherein a DC current was drawn between carbon electrodes and the switch was manually operated so as to draw and extinguish the arc in a manner more or less mimicking bolts of lightning.

This prior art technique suffers from a number of drawbacks. First, there is the obvious safety question of using a person to manually draw an arc using a scissors switch between two electrodes. Second, even when the scissors switch can be used safely, its use takes a toll on the DC generators used to produce the power to draw the arc, since the DC generator is essentially short circuited when the arc is drawn. Third, since the scissors switch is manually operated, the mimicked lightning bolts were not repeatable. Thus, for stage or theatrical productions, the lighting bolts would not be repeatable from performance to performance, and therefore they could not be easily timed to music or other events occurring during the performance. For movie or video work, when the same scene goes through a number of takes, each of the takes would have a different lightning display, thereby making it more difficult to edit the movie or video with scenes from different takes. There is no practicable way of varying the intensity of the flashes of light in the prior art to mimic, for example, intense nearby flashes of lightning and more distant flashes.

The present invention overcomes these difficulties by providing a lamp and driver circuitry for use therewith which can produce short, intense bursts of light or lower intensity bursts (if desired), such as what might be used to mimic bolts of lightning, in a manner which is safe, easily programmable and repeatable, and, moreover, does not require a DC generator and therefore does not adversely impact a DC generator. The lamp has an internal impedance so circuit is limited by the impedance.

BRIEF DESCRIPTION OF THE INVENTION

In one aspect the present invention provides a high tensity, intermittently operated lamp for use in theatrical, stage, movie and video productions. The lamp comprise an elongated tube having electrodes disposed at the ends thereof, which tube is filled with xenon gas at a pressure less than atmospheric pressure. The lamp produces on the order of 40 to 70 lumens per watt when its electrodes are energized.

In another aspect the present invention provides a high intensity lighting system for use in producing relatively short bursts of intense light. The system includes a lamp containing xenon gas at a pressure less than atmospheric when cold, an ignitor, and a switching circuit connected in series with the lamp and the ignitor. The circuit couples the lamp and the ignitor to a source of electrical power in response to a control signal. A control circuit generates the control signal the control circuit including manually operated switches for controlling when the control signal is turned on and turned off. The control circuit also includes a safety circuit for limiting the on time period of the control signal to a predetermined maximum time period.

In another aspect the present invention provides a high intensity lighting system for use in producing relatively short bursts of light, wherein the system includes a lamp, a power supply coupled to the lamp and responsive to a control signal for applying electrical power to the lamp, and a control circuit for generating the control signal. The control circuit includes a counter for counting through a predetermined number of states and multiplexer means responsive to said counter and to the state of selected switches so that the control signal is generated for each state of the counter when its associated switch is in a predetermined state.

In yet another aspect the present invention provides a high intensity lighting system for use in producing relatively short bursts of light, the lighting system including a lamp containing xenon gas and a power supply coupled to said lamp for igniting the lamp in response to a control signal. A control circuit is disposed in a housing located remotely from the lamp, but operationally connected thereto, for providing the control signal to the power supply. The control circuit includes manually operated switches for controlling when the control signal is turned on and off, the housing including connectors for coupling the control signal via a cable to the power supply and further including additional connectors for connecting the control circuit to yet another control circuit in a separate housing thereby increasing the number of manually operated switches available for controlling when the control signal is turned on and off.

DETAILED DESCRIPTION

Figure 1:
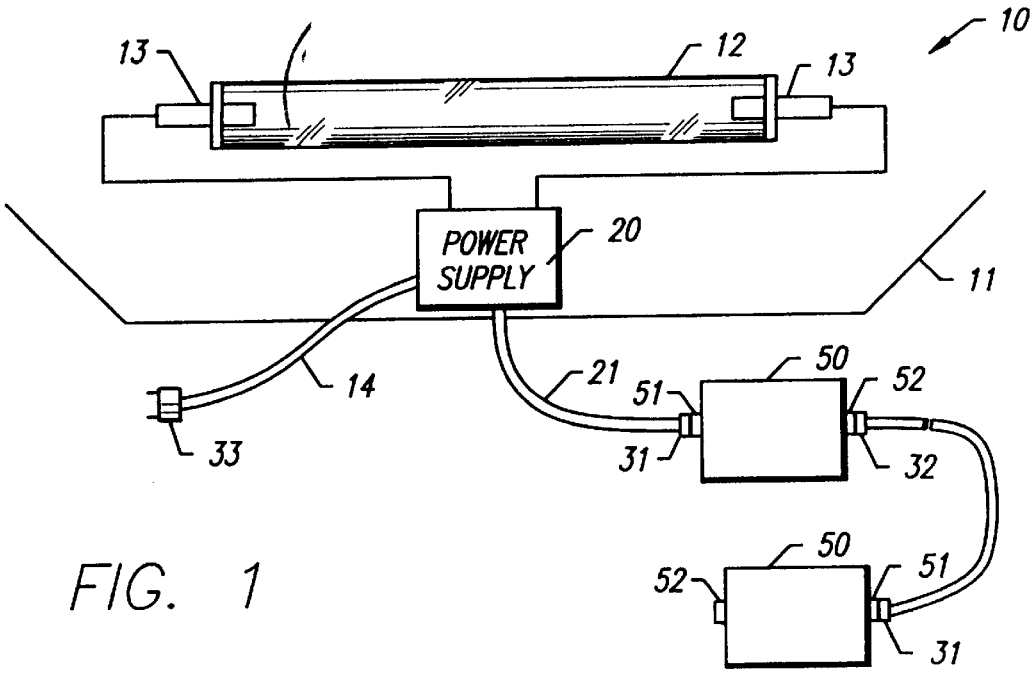
FIG. 1 is a schematic representation of the lamp of the present invention installed in a fixture and this figure also depicts box diagrams of the circuits used to drive the lamp.

FIG. 1 is a schematic representation of the lamp 10 used in the present invention, as well as depicts, using box diagrams, the power switch and ignitor 20 which powers the lamp and a controller 50 which controls the power switch 20. As will be described, multiple controllers 50 may be used in the preferred embodiment.

The lamp is typically mounted in a lamp head or other suitable fixture 11. Since such fixtures are well known in the prior art and since means for mounting lamps in fixtures are well known in the prior art, those details, which are a matter of design choice, are not described herein. The lamp itself and the power switch and controllers which control it, are unique, and therefore are described in detail.

The lamp 10 comprises an elongated glass tube 12, preferably quartz glass, which is sealed at its ends about electrodes 13 which are preferably made of tungsten. The overall length of the lamp, including its electrodes, is typically on the order of 660 mm while the inter-electrode spacing between the two electrodes is on the order of 500 mm. Thus, the arc drawn in the lamp is rather long. The lamp is filled with xenon gas at a pressure of 0.2 to 0.3 atmospheres at ambient temperature. This lamp can be energized with 220 volts AC current and it will then draw 200 to 300 amps and produce approximately 40 to 70 lumens per watt with a Color Rendition Index of 94–96. The lamp has a diameter of approximately 25 mm. When hot, the xenon pressure will increase, but stay below one atmosphere.

Figure 2:
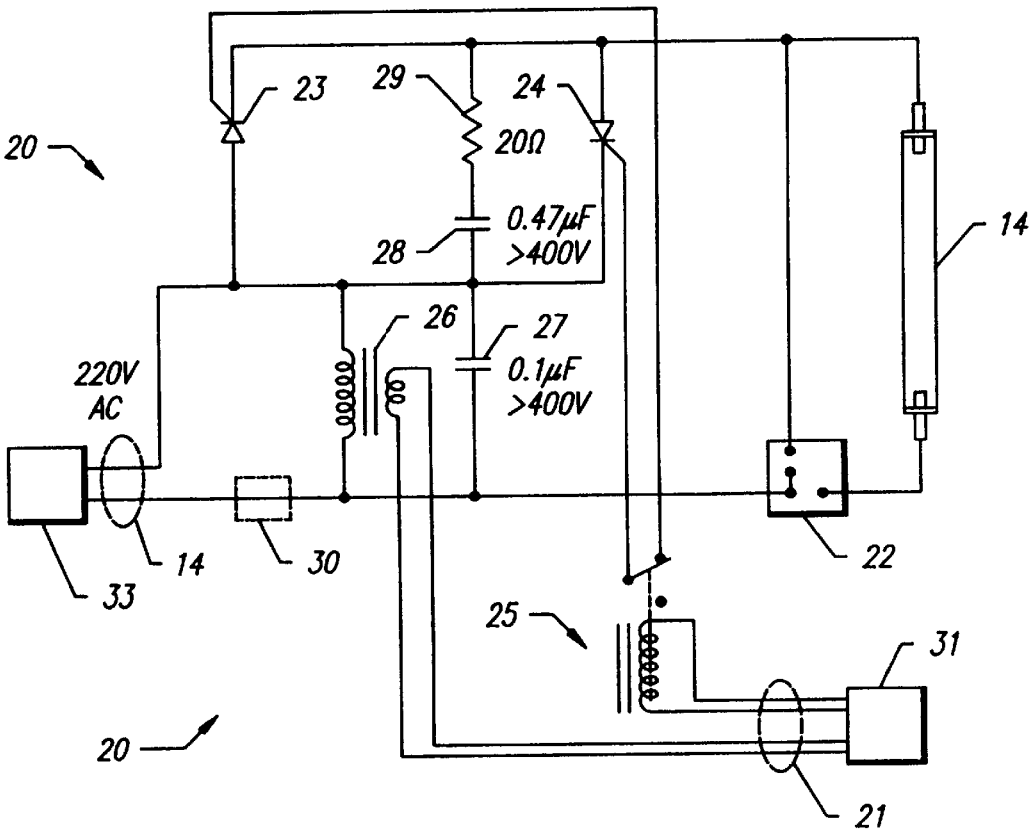
FIG. 2 is a schematic diagram of a first embodiment of the power switch used to drive the lamp.
Figure 6:
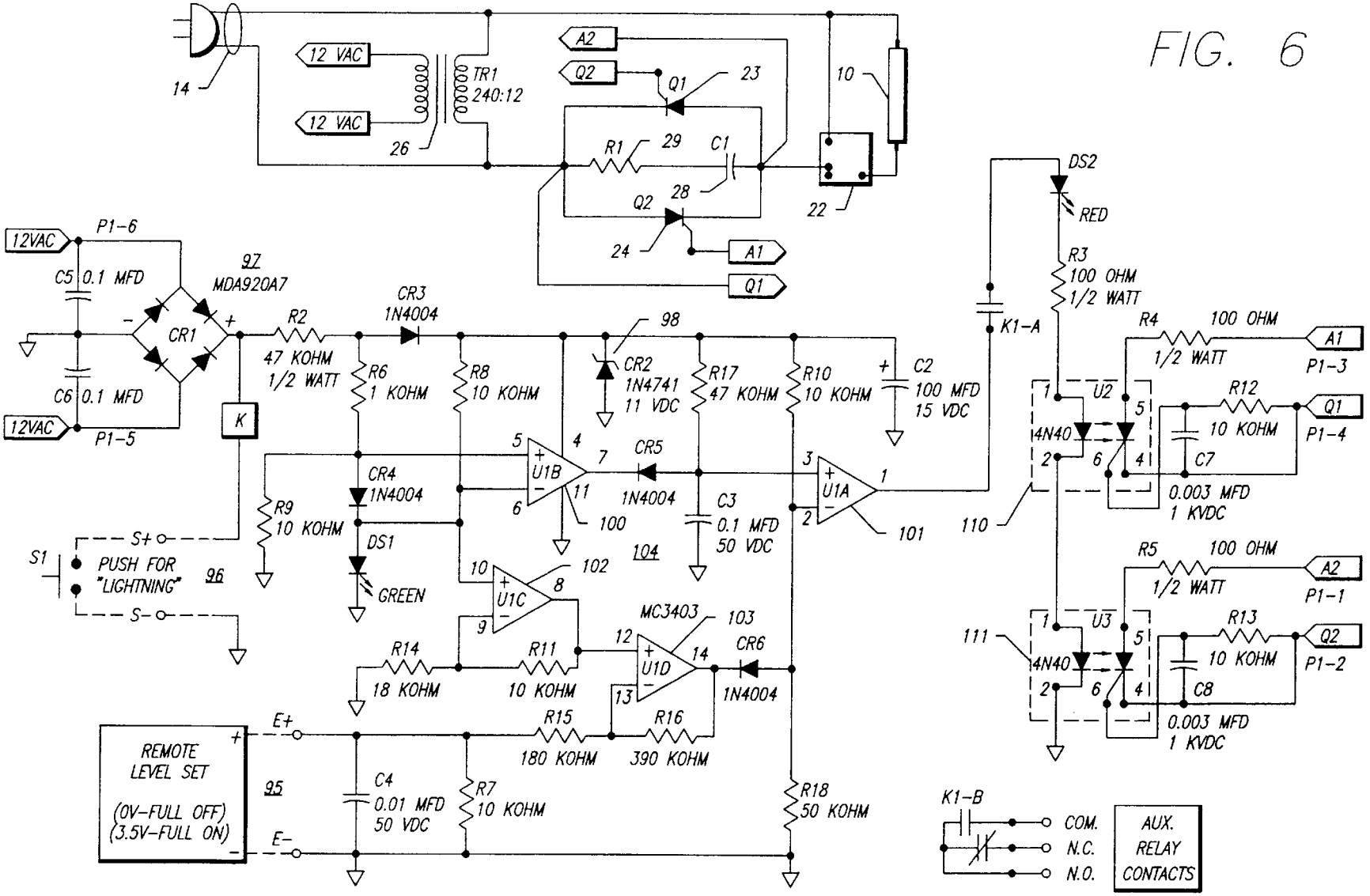
FIG. 6 is a schematic diagram of a second embodiment of the power switch, which switch permits the intensity of the flashes of light to be varied.

The power supply and ignitor 20 will be described in greater detail with reference to FIGS. 2 and 6. The power supply of FIG. 2 is capable of driving the lamp 10 to produce short flashes of high intensity light. The power supply of FIG. 6 is responsive to an intensity control signal and varies the intensity of the light produced by lamp 10 in response to the intensity control signal. The power supply of FIG. 6 will be described in greater detail later in this patent. The power supply of FIG. 2 receives 220 volt AC power, typically via a cable 14 and a conventional connector 33. The power switch and ignitor 20 conveys 12 volt AC power to and receives control signals from one or more controllers 50 via cable 21 which has a connector 31 disposed at the end thereof. Connector 31 mates with a connector 51 on controller 50. The controllers can preferably be connected together in a series fashion by means of cables 33 having connectors 32 and 31 at the ends thereof. Connector 32 mates with connector 52 on controller 50 while connector 31 mates with connector 51 on those controllers which are not connected directly to the power switch and ignitor 20.

Turning to FIG. 2, FIG. 2 is a schematic diagram of the components used in power switch and ignitor 20. The power switch ignitor 20 receives 220 volt AC power via conductors in cable 14. An ignitor 22, lamp 14, and a pair of SCR switching devices 23 and 24, are connected in series with the aforementioned source of power. Ignitor 22 is commercially available from L.P. Associates, Inc., of Hollywood, Calif. 90038 under Model No. LS2. This ignitor accepts a 220 V input and outputs >50 KV pulses at a maximum, intermittent load of 400 Amps.

The SCR's should be rated for 800 volts, 470 amps and suitable SCR's for this application are available from National Electronics of Chicago, Ill. under Model No.NLC290. These SCR's are rated at 800 Volts, 470 Amps.

The gates of the two SCR's 23, 24 may be connected together by means of the contacts of a 12 volt relay 25 which is controlled by controller 50, as shown in FIG. 2, or they may be driven by an external current source as shown in FIG. 6. In the embodiment of FIG. 2, a small series resistor may be used, if desired, to limit the gate current. When the relay closes, lamp 14 is energized. Across the SCR's are preferably connected a 20 ohm resistor 29 and a 0.47 microfarad capacitor 28. Across the input power supply is connected a 0.1 microfarad capacitor as well as a 220 volt to 12 volt step down transformer 26. The secondary of transformer 26 provides a 12 volt AC source of power to controllers 50 via cable 21.

A ballast and/or fast acting circuit breaker may also be connected in series with the ignitor 22, lamp 14 and SCR's 23 and 24, such as is diagrammatically depicted at numeral 30. Of course, whether or not a ballast and/or a fast acting circuit breaker is used does not particularly effect the way the present circuitry operates, but rather would be added for safety and/or because of local code requirements.

Figure 3:
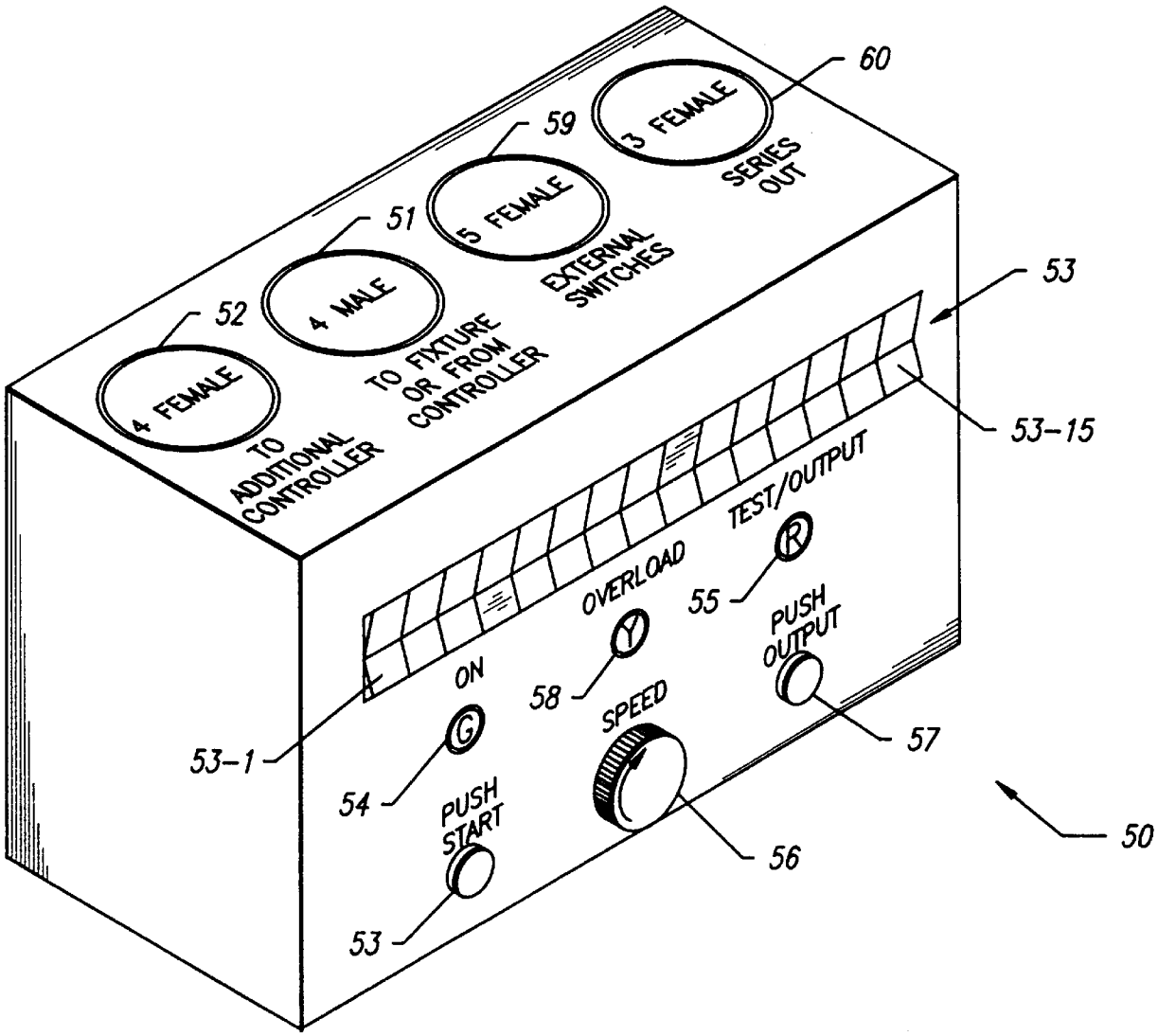
FIG. 3 is a perspective view of a housing for a control circuit used to control the power switch, this view showing the various controls, connectors and indicators which are present in the preferred embodiment of the invention.

FIG. 3 is a functional view of the various controls and connectors which would be available on the housing of controller 50. Two connectors, namely, connector 51 and connector 52, have already been described. Connector 51 may be a male connector, for example, for connecting the controller 50 either to lamp fixture 10 or from another controller 50, while connector 52 may be a female connector for connecting controller 50 to an additional controller 50.

A number of switches 53, in this case, fifteen switches, are shown on the housing. These switches are the on-off type and can be rocker switches or depression switches, as a matter of design choice.

When the start button 53 is operated, the controller starts counting in a counter IC 65 (FIG. 4) at a speed which is controlled by a timer circuit which in turn is controlled by a potentiometer 56. As the controller counts through fifteen different states, a control signal is provided to relay 25 depending upon whether or not a switch 53 associated with each time period has been turned on. Thus, the user of the controller can control the sequencing of the flashes from lamp 12. For example, the length of the on periods and the length of the off periods of the flashes can be controlled by appropriate positioning of switches 53 and by controlling potentiometer 56.

In operation, the switches 82 are set in some pattern and if start button 53 is depressed, then the pattern of flashing which the lamp 12 will ultimately produce will appear at a Light Emitting Diode (LED) 55. Thus, the pattern of switches 53 and the speed control 56 can be varied until a suitable pattern of flashing is seen at LED 55.

Output switch 57 controls whether or not the control signal generated within the controller is actually supplied to relay 25. Thus, output switch 57 permits the flashing pattern to be tested without causing lamp 12 to be energized. Switch 57 can either be a push to close switch, or alternatively, it can be a toggle type switch. In any event, once a suitable patter of flashing is seen at LED 55, the flashing can be tested using lamp 10 or actually used for production purposes by closing switch 57 and thereafter closing switch 82.

As will be seen, the switches 82 and 57 need not be operated locally, but rather their circuits can be closed from a remote location by an appropriate connection made to connector 59.

As has been previously indicated, a number of controllers 50 can be connected logically in series so that after one controller counts through its fifteen states, it can cause the next controller to start counting to its fifteen states, should more than fifteen states be required for a desired pattern of flashing of lamp 10. To that end, connecter 60 provides an output which when connected to connector 59 of a controller 50 downstream, can be used to electrically close switch 53 so as to cause the pattern of flashing at the subsequent controller 50 to be initiated. Of course, many controllers can be connected together in this fashion or in parallel for more complex patterns of light. Additionally, the last controller in the series may likewise be connected to the first controller in the series making an endless loop with a continuous and repeating output sequence. This sequence begins with the closure of any switch 82 in the series and ends after the disconnection of any 2 controllers. Also, connector 59 can be used to permit the push-start switch 82 and switch 57 to be controlled from an external source or location, if desired. For example, if it were desired to control the lightning flashes to be in alignment with music or other lighting effects during the production of a theatrical work which was under, for example, MIDI control, then switch 53 could be effectively closed using a MIDI device by the external connection available through connector 59. Alternatively, a MIDI port could be placed on the housing itself so that the MIDI data could be applied directly to controller 50, as will be discussed with reference to FIG. 5.

Figure 4A:
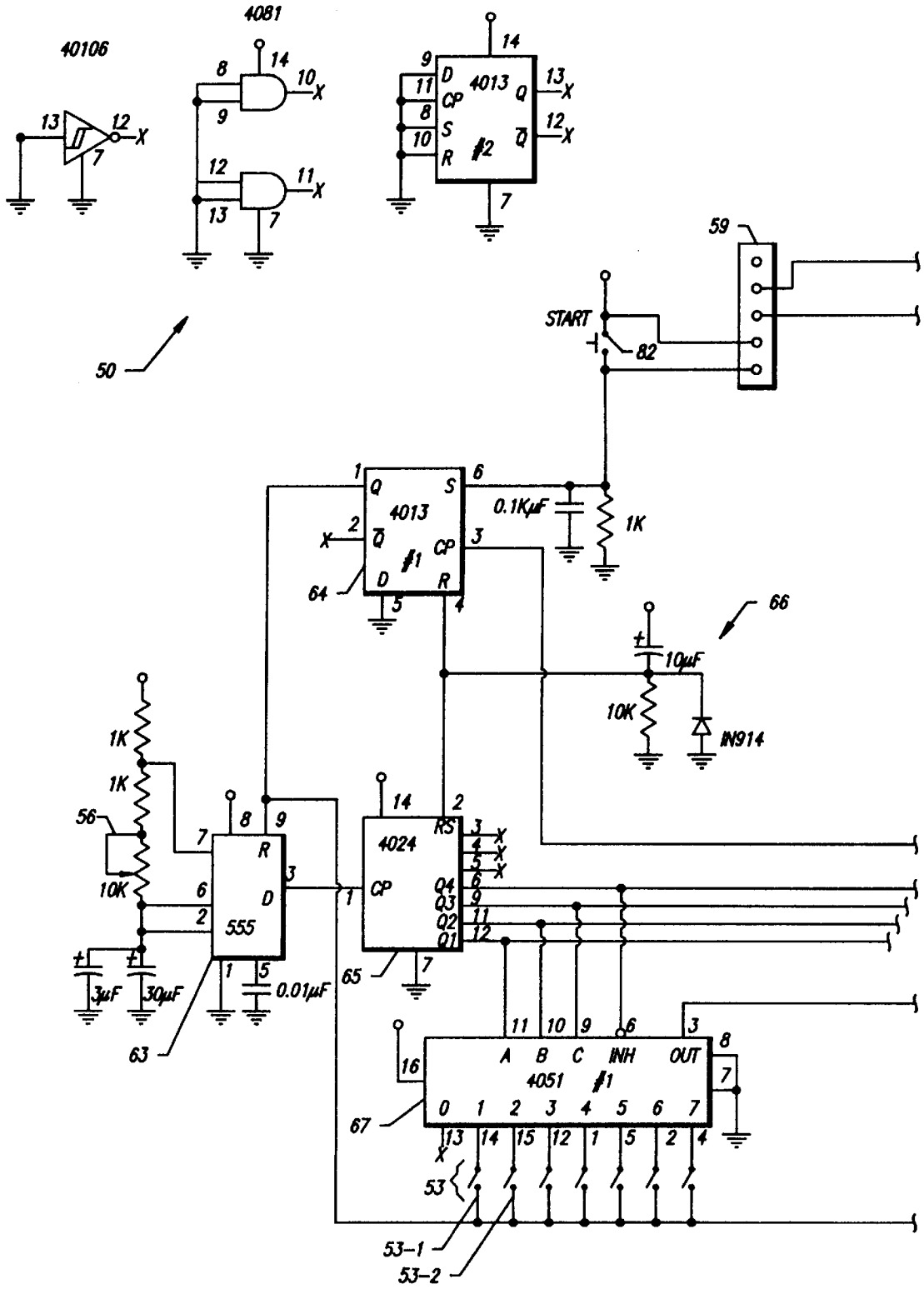
FIGS. 4A and 4B form a logic diagram of the control circuit, which logic diagram is hereafter referred to as FIG. 4.
Figure 4B:
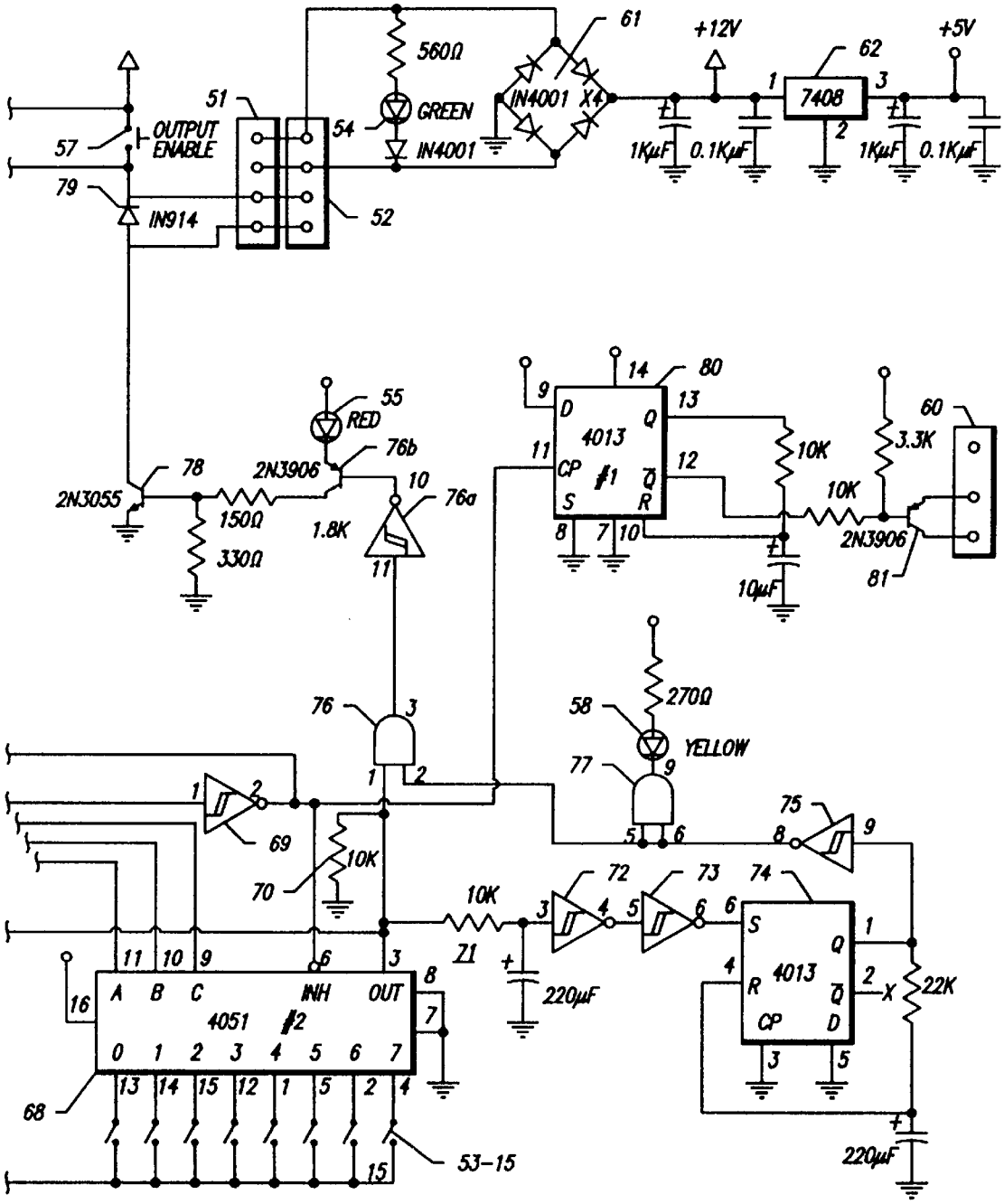

FIG. 4 is a logic diagram of controller 50. As indicated above, 12 volt AC power is applied via connector 51, the pins of which are connected to a full wave bridge rectifier 61 so as to provide a 12 volt DC source and to a regulator 62, the output of which provides a 5 volt DC source. The 5 volt DC source is used as a supply to the various IC's whereas the 12 volt DC source is used to provide the output signal to relay 25 (FIG. 2).

Potentiometer 56 controls the frequency of a timing IC 63, which is preferably provided by a type 555 IC. Timing IC 63 is reset by the Q output of flip-flop 64 which may be preferably provided by a type CD4031B IC. Flip-flop 64 is, in turn, triggered by a momentary closure of switch 53, to start counting in a counting IC 65. The output of IC 63 on pin 3 is applied to counter IC 65, which is preferably provided by a type CD2024B type IC. A power up reset circuit 66 resets both IC 64 and IC 65.

The output of counter IC 65 on pins Q1–Q4 are applied to three inputs and to an inhibit input (INH) of a pair of demultiplexes IC's 67 and 68, the most significant bit of the output from IC 65 on Q4 being inverted by invertor 69 before being applied to IC 68. IC 67 and 68, when not inhibited, each select one of eight inputs (0–7) to be connected to its output (OUT). As can be seen, switches 53 are each wired in series with an input 1–7 of IC 67 or an input 0–7 of IC 68 with the Q output from flip-flop 64. The outputs of the two multiplexers IC 67, IC 68, are coupled together and coupled to ground via a resister 70 and are also coupled via an RC timing circuit 71 to the input of a Schmidt trigger invertor 72. The output of the Schmidt trigger 72 invertor is applied via another invertor 73 to the set (S) input of a flip-flop 74. The Q output of the flip-flop 74 is applied via an invertor 75 as one input to an AND gate 76, the other input being the outputs from IC 67 and IC 68. The output of invertor 75 is also applied via an AND gate 77, which is merely used as a driver, for LED 58.

The RC circuit 71 in combination with the Schmidt trigger invertor 72 operates with a 2.2 second time period. The RC circuit 71 in combination with the flip-flop 74 and the related circuitry causes a logic level 0 to appear on pin 2 of AND gate 76, thereby turning off that AND gate should an output from either one of the multiplexers IC's, 67 or 68, exceed 2.2 seconds. This is a safety circuit to ensure that the lamp 10 will not be energized for longer than a predetermined period of time, which in this embodiment is set at 2.2 seconds. Generally speaking, the low pressure long arc xenon lamp 10 should not be energized for more than 3 seconds continuously. Whenever the output of invertor 75 goes to a logic level 0, that causes LED 58 to light, indicating that an overload condition is occurring, thereby alerting the user of the device to reprogram it using switches 53 so as to use fewer continuous on time periods or adjust timer potentiometer 56 to use shorter time periods.

The output of AND gate 76 is coupled via an invertor **76*a* and resistor to the base of a transistor 76*b* which drives LED 55 from which the user can determine the pattern of light flashing which will occur when the switch 57 is closed. The collector of transistor 76*b* is coupled via a resistor to the base of a transistor 78 which, in turn, provides a current flow path from the 12 volt DC source via switch 57, relay 25 (FIG. 2) which is coupled via connector 51. Diode 79 protects transistor 78** from the fly back caused by the switching of current through the relay's coil in a manner well known in the art.

The closure of one or more of the switches 53 causes relay 25 to be energized whenever counter 65 counts to a count for which the associated switch is closed. There is no switch in the zero position, since that, of course, is the state which counter 65 assumes before the start button 53 is depressed. At the end of the sixteen clock cycles, the output of invertor 69 goes high and flip-flop 64 and flip-flop 80 are then reset. Flip-flop 80 is connected as a one shot so that its Q goes low for a short period of time in response to the positive going pulse outputted from invertor 69. The Q output is applied via a resistor network to the base of a transistor 81, causing that transistor 81 to go into saturation for a short period of time after counter 65 has counted through sixteen states. Those skilled in the art will appreciate the fact that when the collector and emitter of transistor 81 are connected across the start button 53 in another identical controller by suitable cabling between connector 60 of one controller and the connector 59 in the subsequent controller, that the subsequent controller is caused to immediately start counting at the conclusion of the sixteen counts in the preceding controller. Of course, the number of states through which a controller counts is a mater of design choice.

Figure 5:
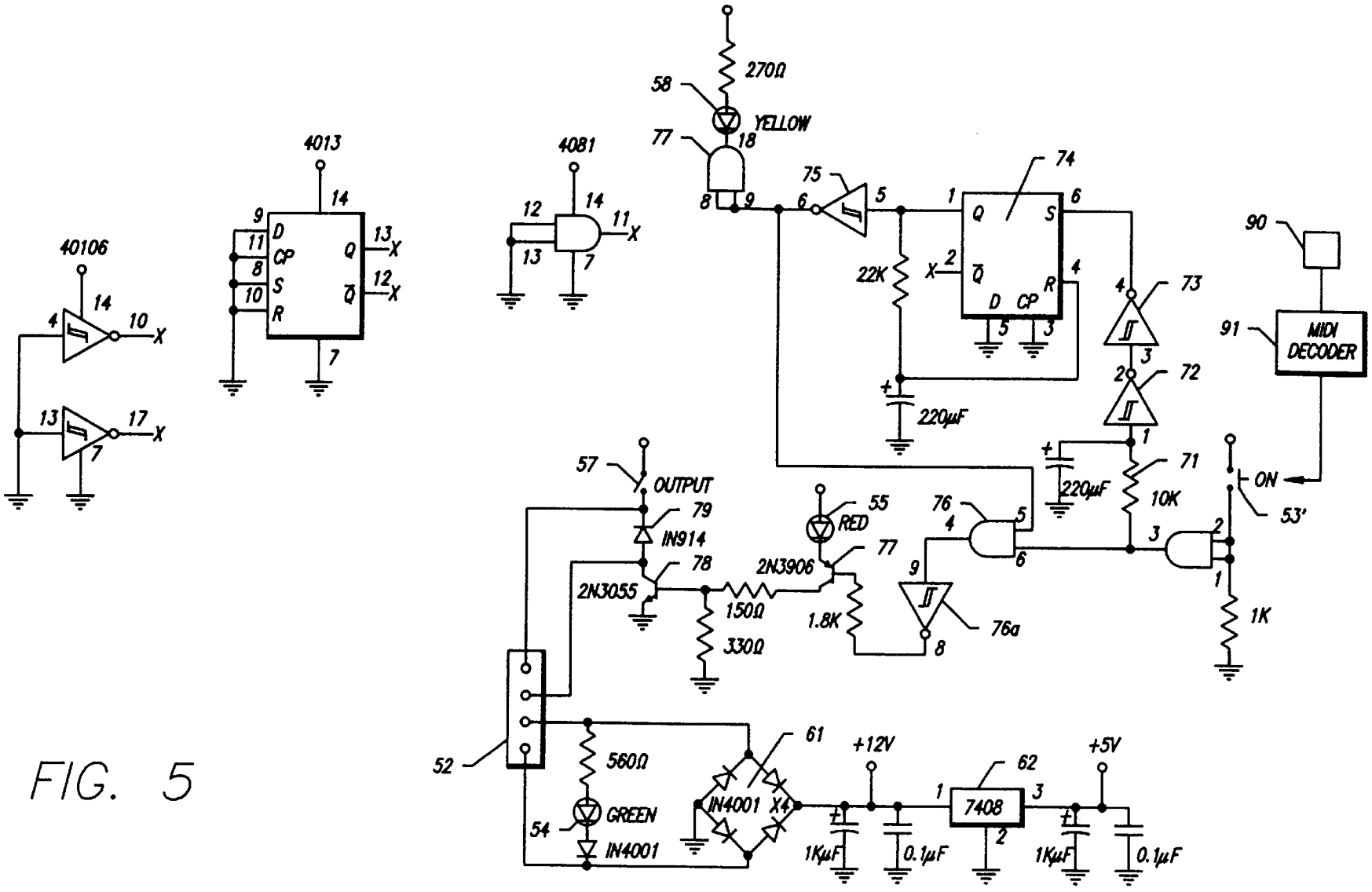
FIG. 5 is a logic diagram of a manually-operated or MIDI-operated control circuit.

FIG. 5 is a schematic diagram of a manual or MIDI lighting controller which is rather similar to the controller of FIG. 4, but does not include the timer, counter or multiplexer IC's. Instead, the flashing is controlled either manually by depression of a switch 53' or by electrically closing those contacts in response to a MIDI signal, for example, received at a connector 90 on the housing of the controller, and coupled to a MIDI decoder 91. Since the operation of the circuitry of FIG. 5 otherwise closely parallels the operation of the circuitry of FIG. 4 and since the same reference numerals have been used with reference to the components which perform the same functions in FIG. 4 and in FIG. 5, further description of this logic diagram should be unnecessary for those skilled in the art.

The lamp, power supply and controllers described above are effective for producing short-duration high-intensity flashes of light, either in a programmed sequence or manually, as desired. The duration of the flashes can be controlled, but the intensity of the flashes are more or less predetermined based upon the capabilities of the lamp and its power supply. The power supply of FIG. 6 is responsive to an intensity control signal at input 95 for controlling the turn on times of SCR's 23 and 24. Components which are similar to the components in the first embodiment of the power supply (FIG. 2), bear the same reference numbers. Instead of coupling the gates of the SCR's together, as was done in the embodiment of FIG. 2, the gates of the SCR's are energized (so as to turn on the associated SCR) at a selected point during each half cycle of the 60 Hz (or 50 Hz if used) power available on lines 14. The SCR turn on point is at the beginning of each half cycle if a maximum intensity burst is desired, or at a later point in the half cycle if a lower intensity burst of light is desired. As is well known, the particular SCR powering lamp 10 during each half cycle turns off when it becomes reverse biased at the end of the half cycle during which it was forwarded biased and powering lamp 10.

The SCR's 23 and 24 in FIG. 6 are driven by opto-isolators 110 and 111. The opto-isolators electrically isolate the gate control portion 104 of the power supply, which include, inter alia, op-amps 100, 101, 102 and 103 (which operate on only a 11 volt DC power supply formed by diode bridge 97, zener diode 98 and capacitor C2) from the SCR's (which operate with the higher 220 volt AC voltage on lines 14). Although electrically isolated, the gate control portion of the power supply is effective for controlling the turn on times of the SCR's during each half cycle that a SCR is forward biased in response to the intensity control signal applied at input 95.

The power supply of FIG. 6 is controlled by an intensity control signal at input 95 and also by a on-off switch connected at 96. The flashing of lamp 10 can be controlled by closing the switch contacts at 96 and varying the voltage at input 95 between 0 volts (lamp 10 off) to 3.5 volts (lamp 10 at high intensity). Alternatively a voltage can be selected depending on the intensity of light desired, which voltage is applied at input 95 and then the switch connected at contacts 96 can be opened and closed to yield a desire sequence of flashes at lamp 10. Of course, those skilled in the art will now appreciate that lamp 10 can also be controlled by combining the opening and closing of the switch at contacts 96 with a varying voltage at input 95. Closing the circuit at contacts 96 energizes relay 99, closing contact K1-A at the output of op-amp 101, thereby permitting the gate control circuitry 104 to take control of the turn on times of the SCR's 23 and 24.

The switch connected at contacts 96 can be a mechanical switch, if manual control is used to open and close the switch, or alternatively the switch can be an electronic switch, if programmed control is desired to control the opening and closing a circuit across contacts 96.

The controller of FIG. 4 requires modification before it is used with the power supply of FIG. 6, if, for example, the controller is to control the opening and closing of a circuit across contacts 96 and/or the voltage to be applied to input 95. Of course, it would be relatively straightforward to modify the output circuitry comprising elements 76*a*, 76*b*, 78, and 79 to merely open and close an electronic switch bridging contacts 96. Varying voltages can be applied at input 95 by using potentiometers (coupled across a 3.5 volt DC source of power, for example) or other voltage dividers, which potentiometers or dividers are sequentially coupled to input 95 using appropriate transistors to couple the same into and out of circuit connection to input 95. The control electrodes of such transistors can be connected to be responsive to octal decoders, for example, which in turn would be responsive to the binary value output from counter IC 65, for example, in a relatively straightforward manner. In that way only one potentiometer or other voltage divider is in the circuit during a given count of the counter. Of course, the number of potentiometers should equal the number of states of the counter IC 65, and in the case of the embodiment of FIG. 4, that would yield fifteen states and thus fifteen potentiometers (or other voltage dividers).

The op-amps 100–103 may be provided by a quad op-amp IC type MC3483. Op-amp 100 has one input (pin 6) connected to the 11 volt power supply through a resistor R8 and its other input (pin 5) connected to a source of pulsating DC available at the output of diode bridge 97 through a resistor R6. Op-amp 100 acts as a zero crossing detector of the AC power on lines 14. The output of op-amp 100 pulses negative at each zero crossing, thereby discharging capacitor C3. After being discharged, capacitor C3 charges through resistor R17, i.e. as a conventional RC circuit, so that a voltage ramp is applied to a non-inverting input (pin 3) of op-amp 101, which ramp is synchronized to the AC power line so that it restarts with every zero crossing.

Op-amp 102 has one input coupled to pin 6 of op-amp 100 and its other input at pin 9 is coupled to ground via a resistor R14. This op-amp is used to scale a DC reference voltage, provided by the voltage drop across light emitting diode (LED) DS1, to provide an offset voltage at its output, which offset voltage is applied to op-amp 103 at pin 12 thereof. A resistor R11 couples the output of op-amp 102 to its input at pin 9 as a feedback path commonly used with op-amps. The other input of op-amp 103 is connected at pin 13 via a resistor R15 to input 95. Op-amp 103 is configured as an inverting voltage amplifier, offset by the previously mentioned offset voltage, and it ascertains the level of the DC intensity control signal present at input 95. The output of op-amp 103 is connected via a feedback path containing resistor R16 to pin 13 and via a diode CR6 to an input of op-amp 101 at pin 2 thereof.

Op-amp 101 thus has the previously mentioned voltage ramp, which starts over at each zero-crossing of the AC power, applied to its non-inverting input and a settable DC voltage (controlled by the intensity control signal voltage at input 95) applied to its inverting input (pin 2). Thus, op-amp 101 determines the amount of delay time (if any) after a zero-crossing occurs before the then forward-biased SCR is fired. To this end, the output of op-amp 101 is connected via normally open contacts K1-A of relay K1 and via a light emitting diode DS2 and via a resistor R3 to series connected opto-isolators 10 and 11 and thence to ground. In this way, the level of the intensity control signal at input 95 controls when during each half-cycle of the AC power on lines 18 that the SCR's alternatingly fire (one SCR fires during each half-cycle that the lamp 10 is to be energized, the SCR firing being the SCR which is then forward biased by the AC on lines 14). If the SCR's fire at or close to a zero-crossing, the light is intense. If they fire later, the light is less intense.

The disclosed lamp, power supplies and controller are useful in producing short duration flashes of light which can be conveniently used in the production of movies, theater, video, and the like. The intensity of the flashed can be varied or held constant. The length of the flashes can also be varied or held constant, as desired. The bursts can be manually controlled or preprogrammed, as desired.

Having described the invention with respect to certain preferred embodiments thereof, modification may now suggest itself to those skilled in the art. The invention is therefore not to be limited to the disclosed embodiments, except as required by the appended claims.

What is claimed is:

1. A high intensity lighting system for use in producing relatively short bursts of intense light, said system comprising:

(a) a lamp containing xenon gas at a pressure less than atmospheric when at room temperature;

(b) an ignitor;

(c) a switching circuit connected in series with said lamp and with said ignitor, said switching circuit coupling said lamp and said ignitor to a source of electrical power in response to a control signal; and (d) a programmable controller for generating said control signal, said programmable controller including a timer for controlling when said control signal is turned on and turned off and said controller being programmed so that said control signal causes said lamp to produce a repeatable sequence of "bursts" of light, each burst in said sequence having a programmably variable duration and a programmably variable intensity level which intensity level varies throughout the duration of each burst of light.

2. The lighting system of claim 1, wherein said lamp is an elongated lamp having electrodes disposed at the ends thereof, said lamp containing xenon gas at a pressure approximately in the range of 0.2 to 0.3 atmospheres when it is at room temperature.

3. The lighting system of claim 1, wherein said timer includes a group of switches.

4. A lighting system for producing relatively short burst of intense light which mimic lighting for use in theatrical, stage, movie and/or video productions, said system comprising:

(a) a lamp (b) a power supply coupled to said lamp and responsive to a control signal for applying electrical power to said lamp; and (c) a control apparatus for generating said control signal which causes said power supply to switch said lamp on and off in response to changes in said control signal, said control apparatus including a plurality of switches, a counter for counting through a predetermined number of states, each state representing a period of time when said lamp can be energized as said counter counts through said states, each state having a corresponding switch and means responsive to said counter and to the state of said switches so that said control signal is generated for each state of said counter when its corresponding switch is in a predetermined state, said control apparatus further including circuitry for controllably varying the amount of energy delivered by said power supply as said counter counts through each of its states.

5. The lighting system of claim 4, further including output inhibiting means for inhibiting said control signal from occurring longer than a predetermined maximum period of time.

6. A lighting system for use in producing bursts of light, said lighting system comprising:

(a) a lamp;

(b) a power supply coupled to said lamp for energizing said lamp with electrical energy in response to a control signal; and (c) control means for providing said control signal to said power supply, said control means including timing means for controlling when said control signal is turned on and off, said control means also controlling said power supply in a programmable manner to cause said lamp to produce a repeatable sequence of bursts of light, each burst in said repeatable sequence having a programmably variable light intensity level throughout the duration of each burst of light.

7. The lighting system of claim 6, wherein said control means includes a counter for counting to a predetermined number of states and means responsive to the state of said counter and to the state of said timing means for generating said control signal while said counter is in a given state provided that the timing means is in a control signal generating state.

8. The lighting system of claim 7, wherein said timing means include manually operated switches.

9. The lighting system of claim 8, further including control signal limiting means for initiating the generation of said control signal to a predetermined maximum period of time.

10. The lighting system of claim 9, further including output switch means for inhibiting the passage of said control signal to said power supply means except when said output switch means is closed.

11. A power supply for use with a gas filled arc lamp comprising:

(a) a pair of silicon controlled rectifiers coupled in parallel with each other and in series with said gas filled arc lamp and a source of AC power;

(b) gate control circuitry coupled to gates of said silicon controlled rectifiers for controlling the times which each silicon controlled rectifier turns on during a half cycle of said AC power, so that one of said silicon controlled rectifiers turns on at or near the beginning of each half cycle to produce relatively bright light from said gas filled arc lamp and at later times in each half cycle to produce less bright light from said lamp, said gate control circuitry being responsive to a programmable intensity control signal provided at an input of said power supply, said programmable intensity control signal varying with time in a programmed fashion so that the intensity of the light emitted by said arc lamp follows a preprogrammed, repeatable sequence of bursts of light, each burst of light corresponding to a plurality of cycles of said AC power and having an increasing and/or decreasing light intensity level during at least one of said bursts of light.

12. The power supply of claim 11 further including opto-isolators coupled to said gates and wherein said gate control circuitry includes at least one operational amplifier coupled to inputs of said opto-isolators, said at least one operational amplifier being responsive to a ramp voltage source which is synchronized to the AC power to said intensity control signal.

13. The power supply of claim 12 further including circuit means for switching said at least one operational amplifier into and out of electrical contact with the inputs of said opto-isolators.

14. The power supply of claim 12 wherein said ramp voltage source is provided by a resistor-capacitor circuit, said resistor-capacitor circuit being synchronized to said AC power by another operational amplifier, said another operational amplifier having inputs, one of which is coupled to a DC reference voltage and another of which is coupled to a pulsing DC source derived from said AC power.

15. A method of generating relatively short bursts of light of varying intensity light form an arc lamp and a controlled switch arrangement, said method comprising the steps of:

(a) providing a source of alternating current;

(b) programmably controlling the length of time said alternating circuit is coupled to said arc lamp via controlled switches, said length of time comprising a number of cycles of said alternating current; and (c) programmably controlling the turn on times of said controlled switches during each cycle of said alternating current during said length of time, whereby said lamp produces a repeatable sequence of burst of light, each burst of light in said repeatable sequence having a programmably variable duration and a programmably variable light intensity level which is variable throughout its duration.

16. The power supply of claim 11 further including timing control means for controlling when said gates are controlled by said gate control circuitry to thereby control when said arc lamp is turned on and off to produce a flash of light bridging more than one cycle.

17. The method of claim 15, further including the step of limiting to a maximum length of said alternating current is coupled to said arc lamp.

18. The lighting system of claim 6 wherein said power supply generates AC power for supply to said lamp and wherein the amount of energy supplied during a flash is controlled by varying the amount of energy supplied to said lamp from one cycle to a next cycle of AC power during a flash.

19. The lighting system of claim 18 wherein the amount of energy supplied during a flash is controlled by controllably delaying the coupling of the AC power to said lamp during each half cycle that the lamp is energized.

20. A lighting system for use in producing relatively short bursts of light which mimic lightning flashes, said system comprising:

(a) a lamp;

(b) a switching circuit connected in series with said lamp, said switching circuit coupling said lamp to a source of electrical power in response to a control signal; and (c) a programmable controller for generating said control signal, said programmable controller including a timer for controlling when said control signal is turned on and turned off and said controller being programmed so that said control signal causes said lamp to produce a repeatable sequence of bursts of light, each burst in said sequence mimicing a flash of lightning and having a programmably variable duration and a programmably variable intensity level.

21. A lighting system for use in producing relatively short bursts of light, said system comprising:

(a) a lamp;

(b) a switching circuit connected in series with said lamp, said switching circuit coupling said lamp to a source of electrical power in response to a control signal; and (c) a programmable controller for generating said control signal, said programmable controller including a timer for controlling when said control signal is turned on and turned off and said controller being programmed so that said control signal causes said lamp to produce a repeatable sequence of bursts of light, each burst in said sequence having a programmably variable duration and a programmably variable intensity level and wherein the intensity level of each burst of light programmably varies throughout the duration of each burst of light.

22. The lighting system of claim 21, wherein said lamp is an elongated lamp having electrodes disposed at the ends thereof, said lamp containing xenon gas at a pressure approximately in the range of 0.2 to 0.3 atmospheres when it is at room temperature.

23. The lighting system of claim 20, wherein said timer includes a group of switches for determining whether or not the lamp is energized during an associated state of said timer.

* * * * *